US008449340B1

(12) United States Patent
Zeyger

(10) Patent No.: US 8,449,340 B1
(45) Date of Patent: May 28, 2013

(54) PERSONAL PROPULSION APPARATUS AND METHOD ASSOCIATED THEREWITH

(76) Inventor: Eugene Zeyger, Medfield, MA (US)

( * ) Notice: Subject to any disclaimer, the term of this patent is extended or adjusted under 35 U.S.C. 154(b) by 0 days.

(21) Appl. No.: 13/517,665

(22) Filed: Jun. 14, 2012

(51) Int. Cl.
*B63H 11/00* (2006.01)
*B63B 35/73* (2006.01)

(52) U.S. Cl.
USPC ..... 440/38; 114/55.56

(58) Field of Classification Search
USPC ..... 440/38; 244/50, 4; 114/55.56
See application file for complete search history.

(56) References Cited

U.S. PATENT DOCUMENTS 3,113,550 A * 12/1963 Omer ..... 440/38
7,258,301 B2 8/2007 Li
7,614,355 B2 11/2009 Zeyger
7,735,772 B2 * 6/2010 Li ..... 244/4 A
7,900,867 B2 * 3/2011 Li ..... 244/4 A
2008/0014811 A1 1/2008 Zeyger

* cited by examiner

*Primary Examiner* — Daniel V Venne
*Assistant Examiner* — Anthony Wiest
(74) *Attorney, Agent, or Firm* — Lawrence G. Fridman

(57) ABSTRACT

A personal propulsion apparatus for controllable gliding a rider over a water surface includes a buoyant body unit, a power unit and a thrust assembly with at least two independently pivotable thrust nozzles. An intake unit having receiving and directing portions. A height adjusting arrangement is formed with the directing portion. During motion over the surface of water, the intake unit with the height adjusting arrangement, remains submerged. Upon excessive lifting force being generated the height adjusting arrangement is elevated above the water surface, causing entry of air into the power unit, resulted in decreasing the thrust and lowering the height adjusting arrangement below the water surface into the submerged position, so that the rider assumes the longitudinal motion over the water surface.

15 Claims, 5 Drawing Sheets

PERSONAL PROPULSION APPARATUS AND METHOD ASSOCIATED THEREWITH

FIELD OF INVENTION

This invention relates to recreation devices in general, and in particular it relates to a water-propelled propulsion apparatus adapted for recreation play on water.

BACKGROUND OF THE INVENTION

U.S. Pat. No. 7,614,355 discloses a personal flying water jet apparatus provided with downwardly directed water jet nozzles. While the apparatus is being towed, the kinetic head is developed and pressurized water is discharged at the nozzles producing a thrust resulted in lifting and flying the rider and the apparatus. A major drawback of this apparatus is an independent tug that is constantly needed for its operation.

U.S. Pat. No. 7,258,301 discloses a personal propulsion device having a body unit, a base unit constantly floating in the water, and a substantial delivery conduit providing water communication between both the body unit and the floating base unit. The weight of the device is quite substantial, especially in view of the fact that in use the delivery conduit is filled with water. The base unit includes an engine and a pump, which provides pressurized water for delivery through the conduit to the body unit. However, that unit is expensive to produce and difficult to operate for an average user. One of the substantial drawbacks of this prior art devise is that it requires a high power unit for lifting of not only the total weight of the apparatus including the rider, but also for the lifting of the weight of the substantial conduit filled with water. Further more, an additional power is required to drug the floating base unit, while the apparatus is in motion.

US 2008/0014811A1 discloses a personal flying water jet apparatus equipped with a water engine-pump, water discharge nozzles provided at the rider's backpack unit and a water inlet port connected with the pump by a hose. However, this water jet apparatus is not stable enough in the vertical direction. Further more, it does not have a buoyancy reserve, especially when the engine-pump assembly is not running.

Existing personal propulsion devices suffer additional major drawbacks by requiring additional systems/elements. As a result of the added weight of these systems, a significant amount of engine output and fuel is needed to generate the required thrust to achieve flight. This necessitates larger and heavier engines and, even then, the power-to-weight ratio remains often quite low.

Thus it has been long felt and unsolved need to provide a personal propulsion apparatus and a method associated therewith that is safe, stable, and achieves a higher power-to-weight ratio than the analogous devices known in the prior art. Moreover, it would be desirable to provide a personal propulsion apparatus that provides higher maneuverability, as well as practical travel range and duration.

SUMMARY OF THE INVENTION

As to one aspect of the invention a personal propulsion apparatus is provided for controllable movement of a rider over a water surface. The apparatus comprises a buoyant body unit, a power unit and a thrust assembly with at least two independently pivotable thrust nozzles. The power unit is capable of generating and delivering pressurized water to the thrust assembly. A substantially hollow intake unit has a receiving portion positioned at an angle to a directing portion. A height adjusting arrangement is formed within the directing portion. A conduit provides communication between the intake unit, the power and the thrust assembly.

During the motion of the rider over the surface of water the intake unit with the height adjusting arrangement remains submerged in to the water, so the rider is being self-propelled and glides over the water surface. Upon producing excessive lifting force, the intake unit with the height adjusting arrangement is elevated above the water surface causing entry of air into the intake unit and power unit. This results in decreasing of the thrust and lowering the height adjusting arrangement below the water surface into the submerged position, so that the rider assumes the longitudinal motion over the water surface.

As to still another aspect of the invention, the height adjusting arrangement comprises a plurality of the air-relieve openings disposed within the directing portion along the flow axis, so that during the longitudinal motion of the rider the plurality of the air-relieve openings is submerged and positioned below the surface of water.

The power unit comprises an internal combustion engine adapted to energize a pump capable of delivering pressurized liquid to the thrust assembly.

According to a further aspect of the invention a method of controllable gliding a rider over a water surface by means of a personal propulsion apparatus is provided. The apparatus consists of at least a buoyant body unit with a float, a power unit and a thrust assembly with at least two independently pivotable thrust nozzles, the power unit is capable of generating and delivering pressurized water to the thrust assembly. A substantially hollow intake unit is provided having a receiving portion positioned at an angle to a directing portion which is formed a height adjusting arrangement. A delivery conduit provides communication between the intake unit and the power unit and the thrust assembly. The method includes the following steps: positioning the intake unit with the height adjusting arrangement into a submerged position; developing suction, so as to establish a water flow from the intake unit, through the delivery conduit into the power unit and the thrust assembly; providing sufficient pressurization of water exiting the power unit and discharging the pressurized water through the nozzles, so as to generate the thrust sufficient to elevate the body of the rider at or above the surface of the water. In operation, during the motion of the rider over the surface of water the intake unit with the height adjusting arrangements remain submerged in to the water, so the rider is self-propelled and glides over the water surface. Upon excessive lifting force being produced, the intake unit with the height adjusting arrangement are elevated above the water surface causing decreased of the thrust and lowering the height adjusting arrangement below the water surface into the submerged position, so that the rider assumes the longitudinal motion over the water surface.

As to a further aspect of the invention the height adjusting arrangement comprises a plurality of air-relieving openings disposed within the directing portion along the flow axis, so that upon elevating the air-relieve openings above the water surface an atmospheric air enters an interior of the intake unit, the conduit into the water pump causing decrease of the thrust.

BRIEF DESCRIPTION OF THE DRAWINGS

Referring now to the drawings which are provided to illustrate and not to limit the invention, wherein.

DETAILED DESCRIPTION OF THE INVENTION

Figure 1:
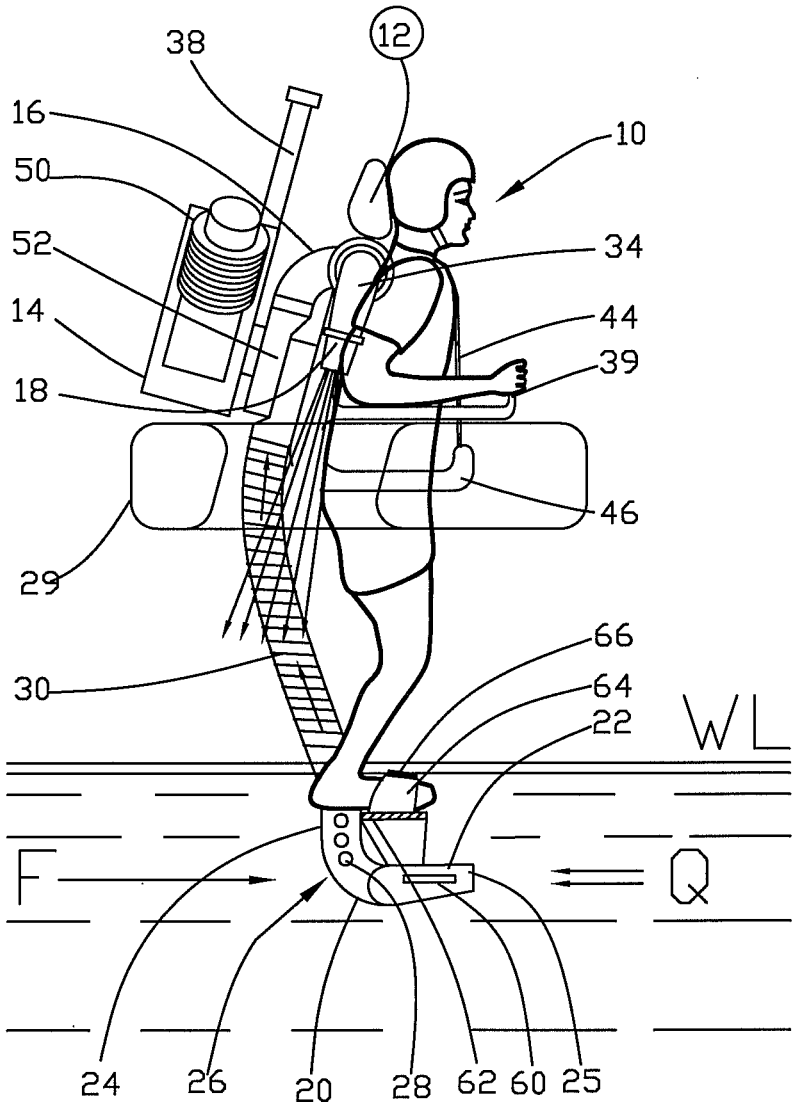
FIG. 1 is a general view of the propulsion apparatus of the invention accommodating a rider.

Referring now to the drawings in general and to FIGS. 1-9 in particular, illustrating a personal propulsion device 10 of the invention which consists of a buoyant body unit 12 with a float 29, a power unit 14, and a thrust assembly 16 with at least two independently pivotable thrust nozzles 18 and 19. A substantially hollow intake unit 20 is provided having a receiving portion 22 and a directing portion 24 positioned at an angle to each other. A delivery conduit 30 establishes communication between the intake unit 20 and the power unit 14 and the thrust assembly 16.

Referring now to FIGS. 1-7 best illustrating the body unit 12, a rider retaining arrangement 40 and a seat assembly 42. The retaining arrangement 40 includes various straps 44, to hold a rider in place and to provide protection and comfort. The body unit 12 is typically made from a lightweight, semi-rigid buoyant material and equipped with a float 29 (mainly inflatable) sufficient to keep the body unit and the rider afloat in water for an extended period of time and specifically during the initial stages of operation.

The seat assembly 42 is formed with a saddle 46 which efficiently supports a part of the weight of the rider and further reduces unnecessary movements and oscillations of the rider's body during use of the device.

Figure 2:
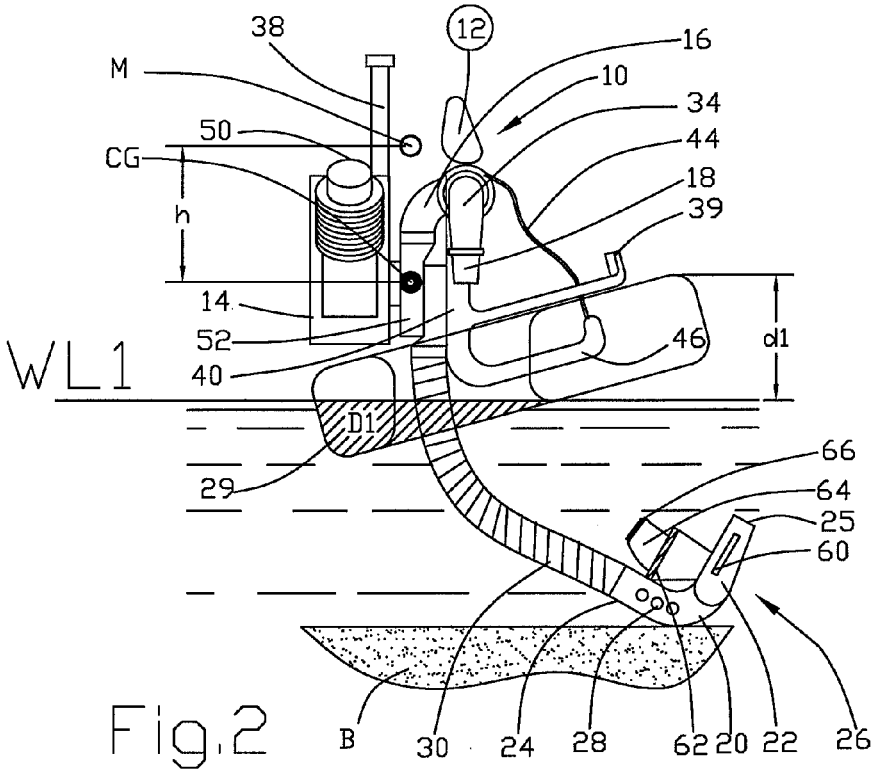
FIG. 2 is a view illustrating the apparatus of the invention floating in water.
Figure 3:
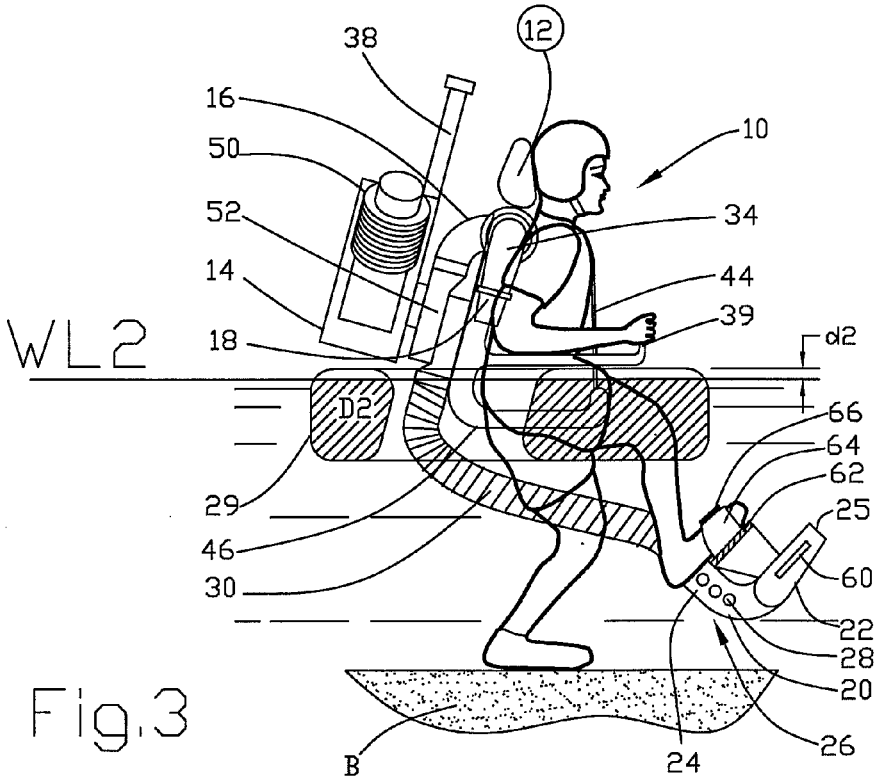
FIG. 3 illustrates the apparatus and the rider in initial steps of operation.
Figure 7:
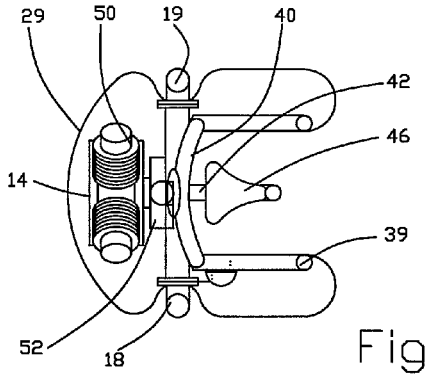
FIG. 7 is a top view thereof.
Figure 5:
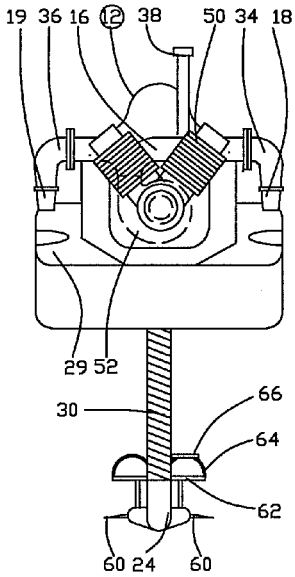
FIG. 5 is a rear view thereof.
Figure 4:
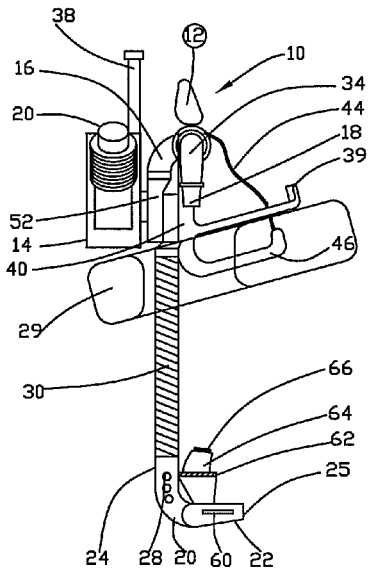
FIG. 4 is an elevation view of the apparatus of the invention.
Figure 6:
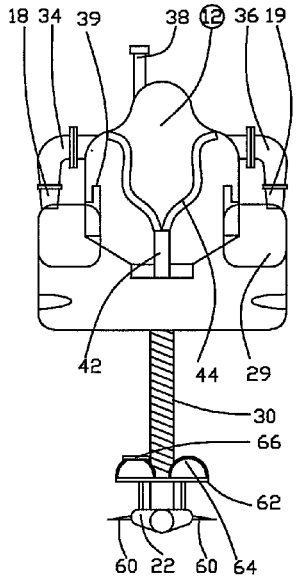
FIG. 6 is a front view thereof.

As illustrated in FIGS. 2 and 3, the body unit 12 is configured so as to have metacenter "M" thereof being spaced from and located above the center gravity "CG" of the apparatus. Upon its placement on the surface of water stability of the body unit is determined by positive distance "h" between the metacenter "M" and the center of gravity "CG" of the apparatus. The float 29 unloaded sub merged displacement "D1" corresponds to water line "WL1" and a buoyancy reserve corresponds to distance "d1". The float 29 loaded submerged displacement "D2" is more of weight of the loaded apparatus and water line "WL2" is located at a level of the rider's stomach, but buoyancy reserve is corresponded to distant "d2".

A power unit 14 is mounted at a rear part of the body unit 12. Although various power arrangements are contemplated, in the preferred embodiment of the invention the power unit is formed as an internal combustion engine 50 which is provided to energize a pump 52. For delivery of air to the combustion chambers, the engine 50 is equipped with air inlet snorkel 38 extending above the head of the rider. By means of the pump 52, suction is developed establishing a water flow from the intake unit 20, through the delivery conduit 30 into the power unit 14 and the thrust assembly 16.

As best shown in FIGS. 1-5, the thrust assembly 16 is formed having first 34 and second 36 swivel housings as well as the first thrust nozzle 18 and the second thrust nozzle 19. The nozzles 18 and 19 are located symmetrically on both sides of the body unit 12 at its upper area and are adapted for independent pivotal/rotational motion. For this purpose, a control sticks 39 are provided, which can be also adapted to control operation of the engine.

By moving the control sticks 39, the rider can change the speed of the engine 50; also can deflect the thrust nozzles to vary the allocation between lift and propulsion force vectors. When the pump 52 reaches a speed sufficient enough to produce the needed pressure, the pressurized water is discharged at the nozzles 18, 19 generating the thrust sufficient enough to lift the rider off the water's surface. In addition a suction effect "Q" of the intake unit 20 increases a horizontal motion force "F".

Figure 8:
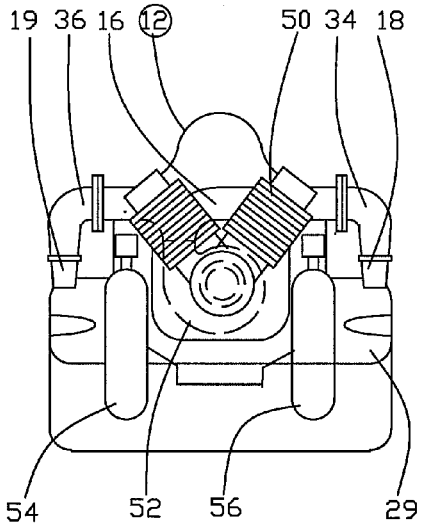
FIG. 8 is partial view of another embodiment of the invention.

The power unit 14 can be provided with an autonomous air supply system adapted to supply air to the internal combustion engine and to protect the engine intake system against water entering the engine, when the apparatus is submerged or semi-submerged into water. As illustrated in FIG. 8, the system includes a compressed air cylinder 54. As further illustrated in FIG. 8, the alternate embodiment of the invention, the power unit can be provided with a cylinder 56 which is disposed at the rear part of the body unit substantially symmetrically to the air cylinder 54. The cylinder 56 contains compressed oxygen. To increase the efficiency of the engine, oxygen is delivered from the cylinder 56 to the interior of the engine to enhance the inefficiency of the fuel combustion and/or decrease weight and size of the engine.

Figure 9:
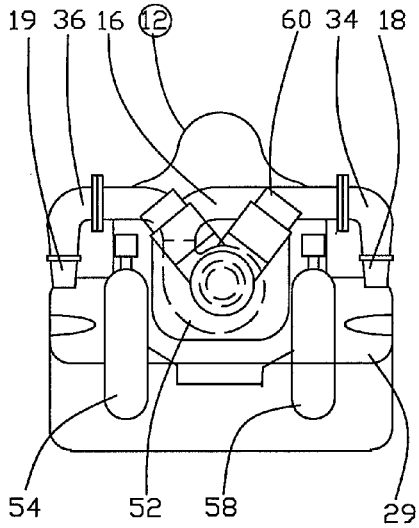
FIG. 9 is a partial front view of a further embodiment of the invention.

As illustrated in the embodiment of FIG. 9, in another embodiment of the invention the water pump can be energized by an air engine 60 (instead of the internal combustion engine) which receives the pressurized gas supply from cylinders 54 and 58. The gas can be delivered either from the cylinder 54 containing compressed air or from the cylinder 58 containing liquefied gas, such as for example carbon dioxide.

The intake unit 20 is formed as an angle-shaped elbow having a substantially hollow interior, with a forwardly directed receiving portion 22 and a directing portion 24 positioned at an angle to each other. An intake opening 25 is provided at the front part of the receiving portion. The directing portion 24 is provided with a height adjusting arrangement 26 which can be in the form of the plurality of the air-relieve openings 28 disposed along the flow axis providing communication between an exterior and the hollow interior of the unit 20. To stabilize position of the intake unit 20, while the apparatus of the invention is in use, stabilizing wings 60 can be formed on both sides of the receiving portion. As illustrated in FIGS. 1-3 the stabilizing wings 60 are substantially flat and extend outwardly in opposite directions from the exterior of the receiving portion in the middle section thereof. In operation, the receiving portion 22 is oriented substantially horizontally and along the direction of the rider movement.

To accommodate feet of the rider, the receiving portion can be equipped with a foot rest 62 with two bindings 64. At least one binding is provided with a clamp 66.

In the preferred embodiment of the invention, a unitary supply conduit 30 provides communication between the intake unit 20, the power unit 14 and the thrust assembly 16. To reduce dimensions and facilitate transportation the conduit 30 is typically made from a resilient and compressible material.

Figure 10:
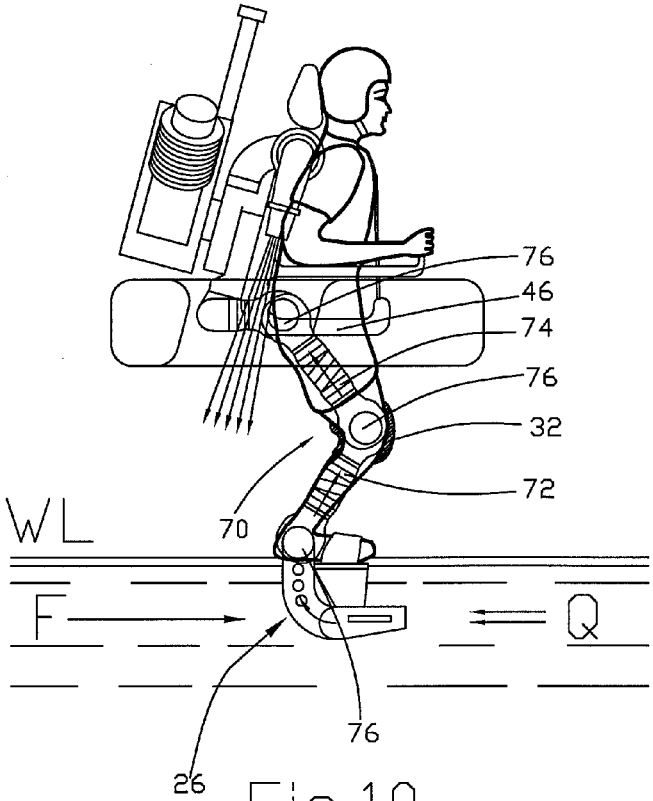
FIG. 10 is a view of still another embodiment of the invention showing a rider.
Figure 11:
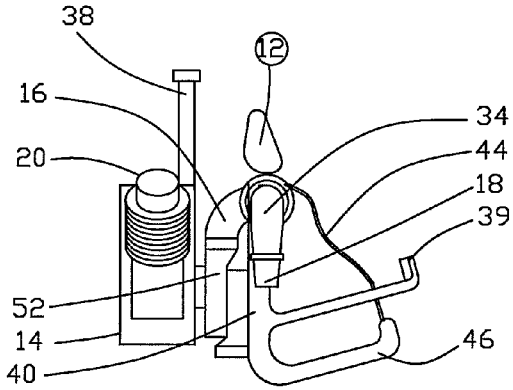
FIG. 11 is a side view of the apparatus without the float.
Figure 12:
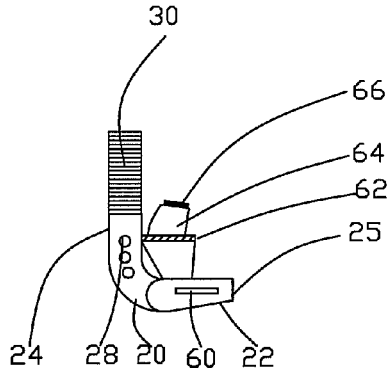
FIG. 12 is a side view showing the intake unit.
Figure 13:
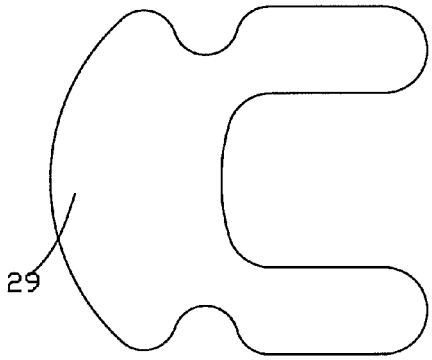
FIG. 13 is one view of the float.
Figure 14:
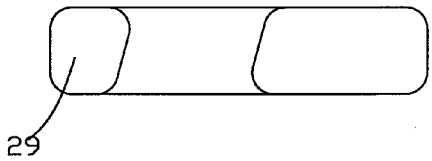
FIG. 14 is a side view of the float.

As illustrated in FIG. 10, in the alternate embodiment, the conduit 70 is provided consisting of multiple sections disposed at or along the rider/rider leg. The conduit sections can be joined by the respective swivel fittings 76. In the embodiment of FIG. 10, the conduit 70 consisting of sections 72, 74 is placed along one leg of the rider. The conduit sections are joined by swivel fittings 76 attached at an area of foot, knee and pelvis correspondently. In use, the first (lower) fitting 76 is attached to the intake unit 20 at the foot area; the second (middle) fitting provided with a clamp 32 and is attached to a knee; and the third (upper) fitting is connected to the seat assembly 46 at the rider's pelvis area.

As best illustrated in FIGS. 2 and 3 buoyant qualities of the body unit 12 facilitate the initial stages of use of the apparatus 10 and the method of its operation. As shown in FIG. 2, initially the body unit 12 including the rider retaining arrangement 40 and the power unit 14 float on the water surface. To simplify initial placement of the rider within the apparatus, it is desirable to place the apparatus in a shallow area. While the body unit assembly is floating, the intake unit 20 is positioned at the bottom, with the conduit 30 extending between the directing portion 24 and the power unit thrust assembly combination. When the engine 50 is started, the apparatus in the floating condition at water line "WL1" and with positive vertical stability "h" is ready for use.

The next step of operation is illustrated in FIG. 3 showing the operator sitting on the saddle 46 with the straps 44 of the retaining arrangement being fastened. As illustrated in FIG. 3, one foot of the rider is positioned within the binding 64 associated with the intake unit 20 and locked by the clamp 66. The other foot of the rider, not associated with the binding is free for independent movement. Such free leg rests on the bottom "B". This arrangement facilitates stability and maneuverability of the rider while entering and exiting water. Buoyancy of the apparatus in that time is under position of water line "WL2" which is at the level of rider's stomach.

In operation the intake unit 20 is submerged and oriented such that the receiving portion 22 is positioned substantially horizontally and the directing portion 24 is oriented substantially vertically. One foot of the rider is supported by the footrest and secured by the binding. During the longitudinal motion, the intake unit supporting one foot of the rider remains submerged and situated below the surface of the water.

When the engine is running, water is inducted through the intake unit 20 into the delivery conduit 30 providing communication with the power unit 30 and thrust assembly. Upon the water flow being delivered into the pump, impeller transfers energy to the water to increase its speed and pressure. In this manner suction is developed establishing the water flow from the intake unit, through the delivery conduit into the power unit and the thrust assembly. The produced flow of pressurized water is routed to the thrust nozzles 18 and 19.

As the engine power output increases, the pump reaches the speed sufficient enough to produce the needed pressurization. The rider places the second foot in the available second free binding. The pressurized water is discharged through the nozzles, generating the thrust sufficient to elevate the body of the rider above the surface of the water. Upon providing sufficient pressurization of water exiting the pump, the water mass flow rate discharged at the nozzles generates sufficient thrust to bring the rider into the upright position and to lift the weight of the rider including the apparatus 10 of the invention above the surface of water, for a sustained period of time. Upon pivoting the nozzles, the flow of pressurized water exiting the nozzles is oriented at an angle to the vertical, providing a horizontal component to the motion forces, resulted in the longitudinal motion of the rider along the water surface. Thus, at any angle of nozzles produced as a result of their pivotal motion, the thrust produces the lifting vertical force and the horizontal force facilitating the longitudinal motion. By means of the control stick the rider can change the motion speed and the direction of thrust for maneuverability.

As further illustrated in FIGS. 1 and 10, in operation the rider is being self-propelled and glides over the water surface with the water intake unit 20 being submerged or situated below the water surface at a predetermined depth. For a proper operation of the invention it is essential for the openings 28 of the height adjusting arrangement 26 to be positioned below the water surface.

When the engine is being over-powered and the thrust being increased beyond the predetermined limits, the excessive lifting force is produced, so that the intake unit 20 supporting the foot of the rider is lifted. In this motion, the relieve openings 28 of the height adjusting arrangement are elevated above the water surface. Due to the existing suction, air from atmosphere is sucked in or percolated through the openings 28 into the directing portion and the conduit. Eventually, the atmospheric air enters into the water pump, causing decreased of the thrust. As a result, the intake unit 20 with the relieve openings 28 is lowered into the submerged position. This re-establishes flow between the intake unit 20 and the thrust assembly 16, enabling the rider to assume his longitudinal motion and gliding along the water surface as discussed hereinabove.

It has been demonstrated above that the present invention provides a personal propulsion water jet apparatus which is safe, stable and does not require a significant amount of engine output and fuel to generate sufficient thrust to achieve movement of the rider, resulting in the increased the power-to-weight ratio. The present invention also provides a personal propulsion apparatus having higher maneuverability, as well as substantial movement range and duration.

What is claimed is:

1. A personal propulsion apparatus for controllably gliding a rider over a water surface, comprising:

a buoyant body unit, a power unit and a thrust assembly with at least two independently pivotable thrust nozzles, the power unit is capable of generating and delivering pressurized water to the thrust assembly;

a substantially hollow intake unit having a receiving portion positioned at an angle to a directing portion, a height adjusting arrangement is formed within the directing portion;

a delivery conduit providing communication between the intake unit, the power unit and the thrust assembly;

the height adjusting arrangement comprises a plurality of air relief openings formed in the directing portion, so that upon elevation of the air relief openings above the water surface air enters the intake unit and power unit causing decrease of the thrust;

wherein during the motion of the rider over the surface of water the intake unit with the height adjusting arrangement remain submerged in to the water, so the rider is being self-propelled and glides over the water surface, upon a further lifting force being produced the intake unit with the height adjusting arrangement is elevated above the water surface causing entry of air into the intake unit and power unit, resulting in decrease of the thrust and lowering the height adjusting arrangement below the water surface into the submerged position, so that the rider assumes the longitudinal motion over the water surface.

2. The apparatus according to claim 1, wherein a plurality of the air relief openings is disposed within the directing portion along the liquid flow axis, so that during the motion of the rider the plurality of the air relief openings is submerged and positioned below the surface of water.

3. The apparatus according to claim 1, wherein the power unit comprises an engine adapted to energize a pump capable of delivering pressurized liquid to the thrust assembly.

4. The apparatus according to claim 3, wherein said engine of the power unit is an internal combustion engine formed with an air inlet snorkel mast extending upwardly from a head of the rider.

5. The apparatus according to claim 4, wherein the engine is equipped with an autonomous gas supply system, a fuel combusted in the engine is mixed with a gas from said autonomous gas supply system, said gas being selected from a group consisting of: a compressed air, a mixture of the compressed air and a compressed oxygen, and a compressed oxygen.

6. The apparatus according to claim 3, wherein said engine of the power unit is an air engine energized by a pressurized gas selected from the group consisting of a compressed air and a liquid gas.

7. The apparatus according to claim 1, wherein a float located at a seat level is provided, so as to have metacenter thereof being spaced from and located above the center gravity of the apparatus, wherein stability of the apparatus being placed on the surface of the water while unloaded is determined by a positive distance between the metacenter and the center of gravity of the apparatus.

8. The apparatus according to claim 1, wherein the intake unit is provided with a foot rest having two independent bindings, wherein one said binding is formed with a quick release clamp adapted to receive and secure one foot of the rider.

9. The apparatus according to claim 1, wherein the delivery conduit consists of multiple sections joined by respective swivel fittings.

10. A method of controllably gliding a rider over a water surface by means of a personal propulsion apparatus consisting of at least a buoyant body unit, a power unit and a thrust assembly with at least two independently pivotable thrust nozzles, the power unit is capable of generating and delivering pressurized water to the thrust assembly, a substantially hollow intake unit having a receiving portion positioned at an angle to a directing portion which is formed with a height adjusting arrangement, a delivery conduit providing communication between the intake unit and the power unit and the thrust assembly; said method comprising the steps of:

positioning the intake unit with the height adjusting arrangement into a submerged position;

positioning the rider on the buoyant body unit with one foot of the rider supported by the intake unit;

developing suction by means of a pump, so as to establish a water flow from the intake unit, through the delivery conduit into the power unit and the thrust assembly; and providing sufficient pressurization of water exiting the power unit and discharging the pressurized water through the nozzles, so as to generate the thrust sufficient to elevate the body of the rider at or above the surface of the water;

wherein during the motion of the rider over the surface of water the intake unit with the height adjusting arrangement remain submerged in to the water, so the rider is being self-propelled and glides over the water surface, upon excessive lifting force being produced the intake unit with the height adjusting arrangement are elevated above the water surface, causing entry of air into the intake unit and power unit, resulted in decrease of the thrust and lowering the height adjusting arrangement below the water surface into the submerged position, so that the rider assumes the longitudinal motion over the water surface.

11. The method according to claim 10, further comprising the steps of:

positioning the body unit with a float on the water surface; and starting the engine and running the engine at idle speed.

12. The method according to claim 11, wherein the height adjusting arrangement comprises a plurality of air relief openings disposed within the directing portion along the flow axis, so that upon elevating the said air relief openings above the water surface atmospheric air enters an interior of the intake unit, the conduit into the water pump causing decrease of the thrust, said air opening is lowered below the water surface into the submerged position, so as to re-establish water communication between the intake and power unit.

13. The method according to claim 11, wherein upon the thrust being increased beyond predetermined limits, the foot of rider including the directing portion are lifted above the surface of water, so that an atmospheric air enters through the air-relieving openings into the directing portion.

14. The apparatus according to claim 6, wherein the liquid gas is carbon dioxide.

15. The method according to claim 10, wherein in the step of positioning the rider on the buoyant body unit said foot of the rider is supported by a foot rest associated with the intake unit.

* * * * *